United States Patent [19]

Rampe

[11] 3,959,932

[45] June 1, 1976

[54] FINISHING SYSTEM WITH CYCLICALLY OPERABLE CLOSURE CONTROL

[75] Inventor: John F. Rampe, Mayfield Heights, Ohio

[73] Assignee: Rampe Research, Cleveland, Ohio

[22] Filed: June 2, 1975

[21] Appl. No.: 582,712

Related U.S. Application Data

[63] Continuation-in-part of Ser. No. 500,094, Aug. 23, 1974, abandoned, which is a continuation-in-part of Ser. No. 270,700, , Pat. No. 3,831,322, which is a continuation-in-part of Ser. No. 8,815, Feb. 5, 1970, Pat. No. 3,685,213.

[52] U.S. Cl. ..... 51/163.1; 51/313

[51] Int. Cl.[2] ..... B24B 31/06

[58] Field of Search ..... 51/163 R, 163 U, 313–316; 241/175

[56] References Cited

UNITED STATES PATENTS 3,449,869 6/1969 Rampe ..... 51/163 R 3,694,968 10/1972 Isaacson ..... 51/163 R

*Primary Examiner*—Harold D. Whitehead

*Attorney, Agent, or Firm*—David A. Burge Co.

[57] ABSTRACT

A finishing machine is provided with a closure which is movable to selectively open or restrict a discharge opening for selectively discharging or retaining materials in the tub of the machine. A pneumatic bellows moves the closure toward a discharge restricting position when supplied with pressurized air. The pressure of the air supplied to the bellows is monitored, and if it exceeds a predetermined magnitude before the closure reaches a discharge restricting position indicating that an object has been trapped by the closure, the movement of the closure is stopped, reversed, and reinitiated to release the object and subsequently move the closure to a discharge restricting position.

25 Claims, 6 Drawing Figures

FINISHING SYSTEM WITH CYCLICALLY OPERABLE CLOSURE CONTROL

CROSS REFERENCE TO RELATED PATENTS AND APPLICATION

The present case is a continuation-in-part of application Ser. No. 500,094 filed Aug. 23, 1974, now abandoned, which was a continuation-in-part of application Ser. No. 270,700 filed July 11, 1972, now U.S. Pat. No. 3,831,322, which was filed as a continuation-in-part of application Ser. No. 8,815 filed Feb. 5, 1970, now U.S. Pat. No. 3,685,213. The two issued patents will be referred to as the "Continuous Feed Patents," and their disclosures together with the disclosure of the abandoned application are incorporated by reference.

FINISHING APPARATUS, U.S. Pat. No. 3,318,051 issued May 9, 1967 to John F. Rampe, here the "Finishing Patent."

FINISHING APPARATUS, U.S. Pat. No. 3,337,997 issued Aug. 28, 1967 to John F. Rampe, here the "Oribital Patent."

BACKGROUND OF THE INVENTION

1. Field of the Invention

The present invention relates generally to finishing machines and more particularly to a vibratory finishing machine of the continuous feed type having a discharge system for controlling the retention time of workpieces within the tub of the machine.

2. Prior Art

Vibratory finishing machines adapted to smooth and finish the surfaces of workpieces by such operations as deburring, burnishing, descaling, and cleaning are well known. Such machines commonly employ a movably mounted processing tub for receiving a quantity of workpieces and abrasive finishing media. A finishing action is imparted to the workpieces by vibrating the tub.

As brought out in the referenced patents, the abrasive media can conveniently be separated from the workpieces after the media and workpieces are discharged from the tub. After separation, the finishing media may then be returned to the tub of the finishing machine for reuse. The finishing liquid is usually drained off during separation of the media and workpieces. The finished workpieces may subsequently be conveyed to a separate unit of group of units for washing, drying, inspection and packaging.

Continuous feed vibratory finishing machines typically provide the processing tub with spaced charging and discharging devices whereby media and workpieces enter one end of the tub and are subjected to a finishing action as they progress through the tub for discharge at the opposite end.

One problem with a number of prior proposals for continuous feed vibratory finishing machines is that the time during which workpieces are retained in the tub is not readily controllable. Workpieces of a relatively soft metal, or workpieces needing only minimal deburring, etc., require only a short retention time. Workpieces of harder metal which have many large burrs to be removed, require longer retention times. Hence, where the retention time requirements differ from that provided by prior continuous feed finishing machines, it has previously been necessary to operate the finishing machine on a batch process basis where the retention time can be carefully controlled.

The machines described in the referenced Continuous Feed Patents are provided with discharge systems for controlling the retention time of workpieces in the tub of the machine. These machines may be operated on a batch basis if desired but are designed primarily for continuous operation according to a prearranged time schedule. Each of the machines has a discharge system including a closure-controlled discharge opening. One of the advantages of these machines is that the closure operating cycle can be adjusted by the operator from time to time to lengthen or shorten the retention time of materials within the tub. The discharge closure can be opened and closed by a timing control device preset to selected intervals of operation.

Once the closure operating cycle has been decided upon, the operator adjusts the timing mechanism to provide the predetermined retention period, typically about ten seconds, for processing the workpieces constituting part of the contents of the tub. This is normally followed by a release period—typically 5 seconds—for partial discharge of materials from the tub. This cycle of closure operation is continually repeated and establishes an effective rate of discharge of materials from the tub which determines the retention time of workpieces in the tub. In some cases, the nature of the workpieces may call for longer or shorter processing times than those mentioned above. In such instances, the operator can readily reset the timing mechanism to provide correspondingly longer or shorter retention periods.

In the operation of the machine, the charging apparatus supplies the tub as required with suitable abrasive processing media. An aqueous finishing liquid is usually introduced concurrently into the tub to facilitate finishing of the workpieces. The workpieces themselves are added by an operator. For all practical purposes, the operation of the charging apparatus is keyed to that of the discharge system and simply returns the abrasive media which has been discharged from the tub back into the tub.

A problem which is not addressed by the inventions of the Continuous Feed patents is that of materials which may occasionally become trapped in the region of the discharge opening between the closure and the sturcture which defines the discharge opening. This problem is of concern where the workpieces being finished can be damaged if trapped by the full force of the closure operator system. The problem can also cause excessive wear to parts of the finishing machine. A resilient liner on the closure, for example, can be caused to wear excessively by repetitive engagements with trapped materials. When discharge structure components are formed from plastic material such as molded polyurethane, they too can wear excessively when trapped materials are repetitively clamped against them.

SUMMARY OF THE INVENTION

The present invention overcomes the foregoing and other drawbacks of the prior art by providing a closure control system which reverses and reinitiates the movement of a discharge closure toward a discharge restricting position when an object has been trapped between the closure and the discharge structure, enabling the trapped object to drop out of the discharge opening.

A fluid operated system is provided for moving the closure toward and away from a tub discharge opening. The pressure of the fluid is monitored as the closure approaches a discharge restricting position. If the fluid pressure rises beyond a predetermined magnitude before the door reaches a predetermined position, as happens if an object is trapped by the closure, the system reopens the closure and then reattempts moving the closure to the predetermined position. If an object is again trapped, the closure will recycle until the closure has reached the desired predetermined discharge restricting position.

A limit switch is engaged by the closure when the closure reaches a predetermined discharge restricting position. The limit switch signals the closure control system to permit a fluid pressure rise without causing the closure to reverse its movement when the closure has reached a predetermined discharge restricting position.

The referenced abandoned parent application describes the preferred discharge restricting position of the closure as a position where the discharge opening is fully closed and sealed. It has been found, however, that the preferred discharge restricting position to which the closure should be moved in many finishing operations is one where the closure is spaced from the structure which defines the discharge opening. The spacing between the closure and the discharge structure is selected so that it is large enough to permit finishing media to pass between the closure and the discharge structure, but small enough to retain workpieces in the tub. Adjustable stops are provided to engage the closure when the closure reaches a predetermined discharge restricting position. By this arrangement, when the closure is moved to its discharge restricting position, the closure control system will cause reversal of closure movement only if a workpiece is trapped between the closure and the discharge structure. Finishing media passing between the closure and the discharge structure will not cause a reversal of closure movement.

It is a general object of the present invention to provide a vibratory finishing machine with a novel and improved closure control system.

Other objects and a fuller understanding of the invention may be had by referring to the following description and claims taken in conjunction with the accompanying drawings.

DESCRIPTION OF THE PREFERRED EMBODIMENT

Figure 1:
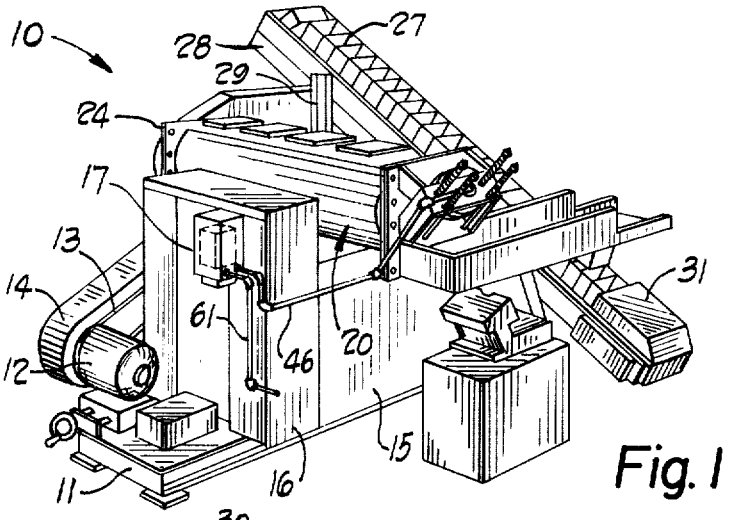
FIG. 1 is a perspective view of a finishing machine incorporating the present invention.
Figure 2:
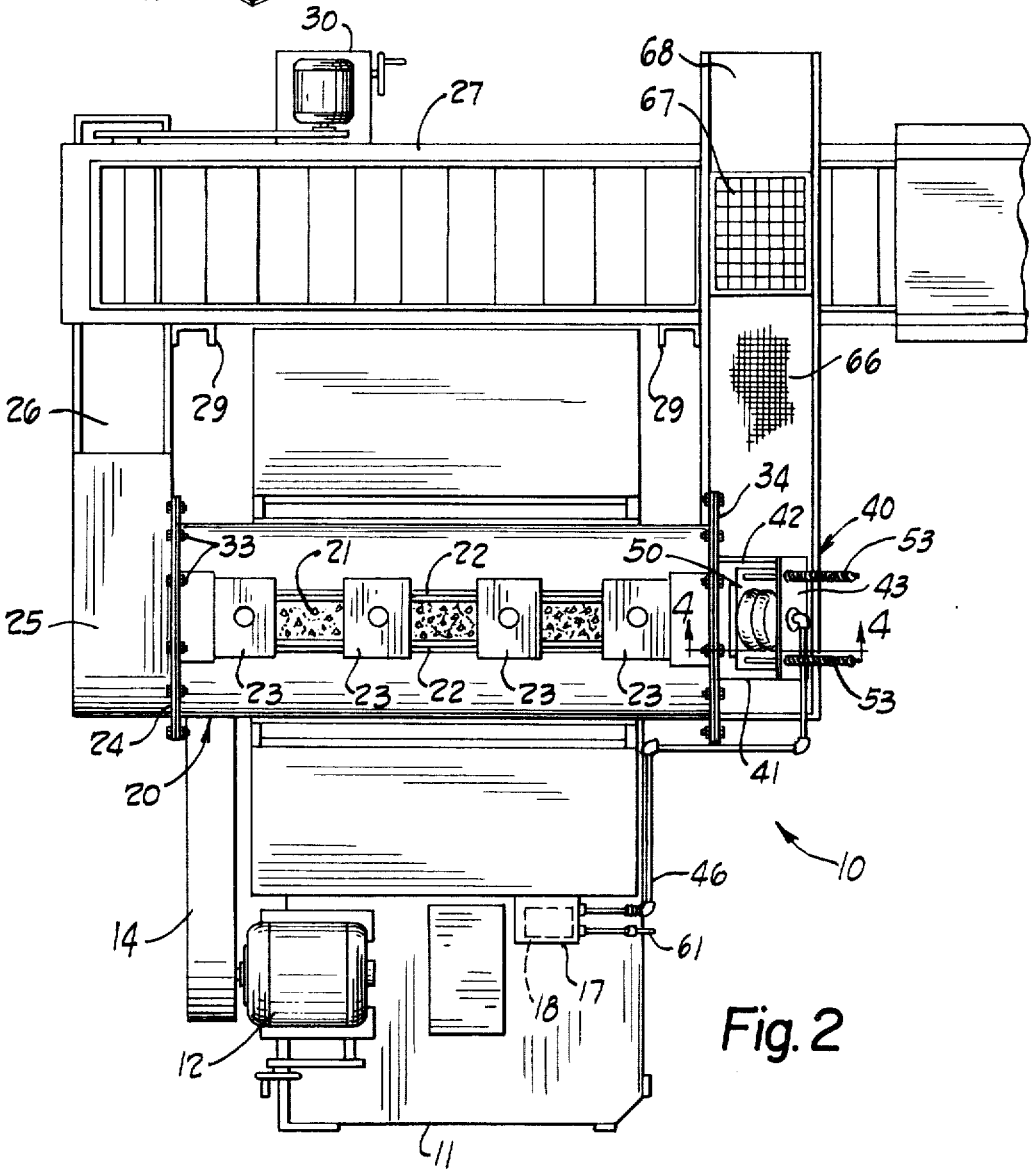
FIG. 2 is an enlarged top plan of the finishing machine.

Referring to FIGS. 1 and 2, a finishing machine is shown at 10. The machine 10 includes a platform 11 which carries an understructure enclosed by a shroud 15. A tub 20 is resiliently mounted on the understructure for receiving finishing media and workpieces to be finished. A drive system including a motor 12 is provided for vibrating the tub 20. A chain belt 13 shielded by a guard 14 couples the motor 12 to other components of the drive system (not shown). A finishing machine of this type is described in the referenced Orbital Patent.

An upstanding control console 16 is positioned adjacent the shroud 15. A control box 17 is carried on the console 16. The control box 17 houses a control system for communicating two fluid conduits 46, 61. Compressed air is supplied to the control box 17 by the conduit 61. As will be explained, the control system of the present invention cyclically communicates the conduits 46, 61.

The tub 20 is of generally cylindrical shape and is supported from beneath as described in the Orbital Patent. A longitudinally extending opening 21 is defined in the top of the tub 20 by mutually diverging wings 22 formed on the tub 20. A plurality of cross heads 23 bridge the space separating the wings 22.

A generally square end plate 24 is aligned with the tub 20 at its charging end, the left end as seen in FIG. 2. A central circular opening of substantially the same diameter as the tub 20 is formed through the end plate 24 to admit finishing media to the tub 20. A hopper 25 is attachhed to the end plate 24 for feeding finishing media through the opening in the end plate 24 and into the tub 20. An elongated top opening 26 is formed in the hopper. The opening 26 receives finishing media dropped from the upper end of a bucket conveyor 27.

The conveyor 27 is mounted in a framework 28 supported by suitable uprights 29. A motor 30 supplies power to the conveyor 27 near its upper end. The lower end of the conveyor 27 is supported within a housing 31. The conveyor 27 provides a means of returning media discharged from the machine 10 back into the tub 20 for re-use.

Figure 3:
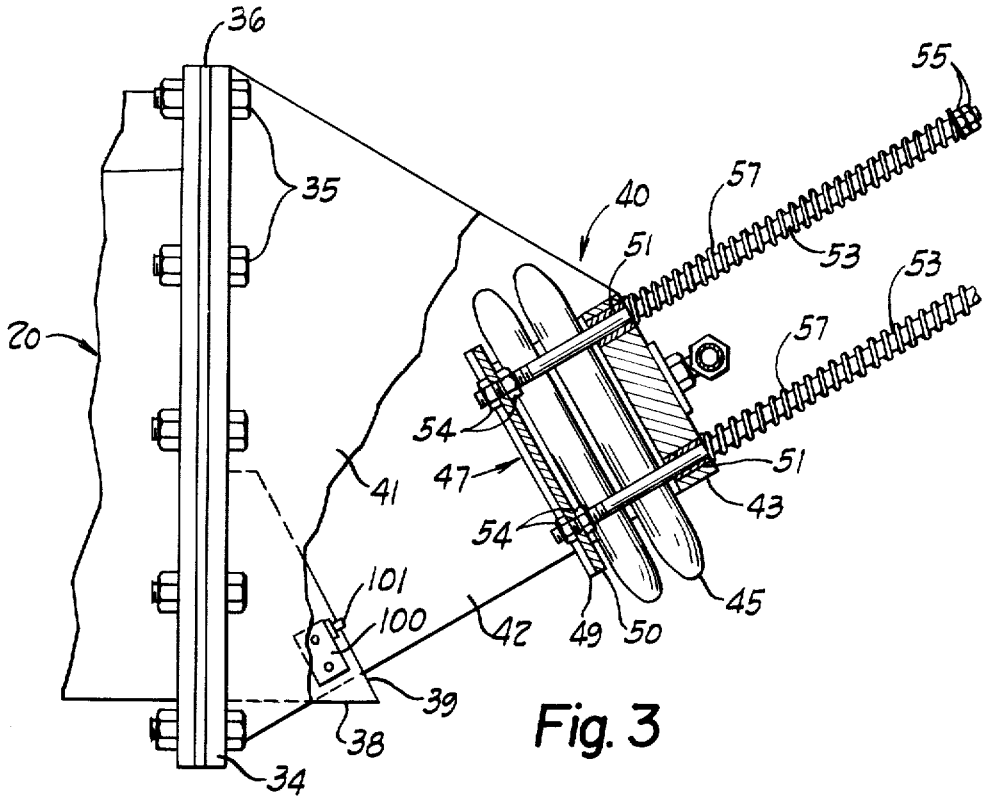
FIG. 3 is a side elevational view showing on a still larger scale the discharge closure assembly of the finishing machine with the closure in an open position.
Figure 4:
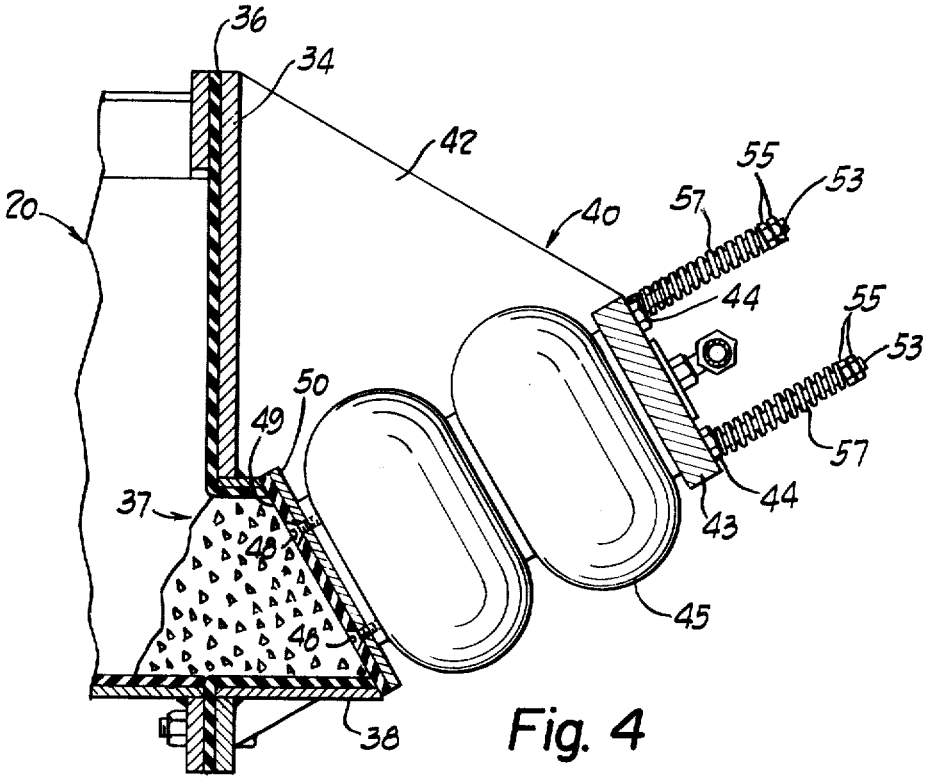
FIG. 4 is a cross-sectional view as seen from the plane indicated by the line 4—4 in FIG. 2, with the closure in a discharge restricting position.

A square end plate 34 is mounted on the right end of the tub 20, as viewed in FIGS. 2–4. A resilient sheet 36 of tub lining material is interposed between the tub structure 20 and the plate 34. Threaded fasteners 35 extend through aligned holes in the plate 34, the sheet 36, and end flange portions of the tub 20 to hold the end plate in place.

The end plate 34 and the lining sheet 36 have aligned central openings 37 which permit the passage of workpieces and finishing media out of the tub proper and into a discharge structure 38. The discharge structure 38 is welded to the end plate 34 to form a part of the tub 20. The right end of the discharge structure 38, as viewed in FIGS. 3 and 4, defines an inclined discharge opening 39. The discharge opening 39 extends in a plane inclined at an angle of approximately 30° from the vertical. By inclining the plane of the discharge opening 39 in this manner, the discharge opening tends to lie in nearly the same plane as the leading surface of materials discharging from the tub structure 20.

A power operated closure system 40 including a bellows 45 functions to selectively open and restrict the discharge opening 39. The closure system 40 includes a heavy metal frame welded to the end plate 34. The supporting frame includes a pair of side plates 41, 42 welded to the end plate 34, and a cross-member 43 welded to the side plates 41, 42. Threaded fasteners 44 extend through apertures formed in the cross-member 43 and mount a pneumatically actuated bellows 45.

The bellows 45 is preferably of the type sold by Firestone Tire and Rubber Company of Akron, Ohio under the designation "Airride 26B." The bellows 45 is expansible during inflation from the deflated configuration shown in FIG. 3 to the inflated configuration shown in FIG. 4. The conduit 46 communicates with an aperture in the cross-member 43 for supplying air to and exhausting air from the bellows 45.

A movably mounted closure assembly 47 is secured by fasteners 48 to the other end of the bellows 45. The closure assembly 47 includes a resilient closure lining sheet 49 adhered to a mounting plate 50. The lining sheet 49 lines the mounting plate 50 and prevents workpieces from being damaged by engagement with the mounting plate 50.

Two pairs of bushings 51 are mounted in apertures formed through the cross-member 43. The bushings 51 slidably receive four guide rods 53. The inner ends of the guide rods 53 are threaded and carry nuts 54 which secure the guide rods to the mounting plate 50. The outer ends of the guide rods 53 are threaded and carry nuts 55. Compression coils springs 57 are carried on the guide rods 53 with opposite ends engaging the nuts 55 and the cross-member 43.

Movement of the closure assembly toward the discharge structure 38 is effected by inflating the bellows 45. Movement of the closure assembly to the open position of FIG. 3 is effected by the four compression coil spring 57 mounted on the guide rods 53. When the bellows 45 is inflated with sufficient pressure, the biasing action of the springs 57 is overcome and the closure assembly 47 is caused to move toward the discharge structure 38. When the pressure within the bellows 45 is released, the springs 57 move the closure assembly 47 to the open position, collapsing the bellows and exhausting air through the conduit 46.

Materials discharging through the opening 39, drop into a substantially horizontally disposed trough 65. The trough 65 is provided just above its bottom with an inclined fine mesh screen 66. The openings in the screen 66 are small enough to prevent the passage at workpieces and finishing media therethrough while allowing the entrained finishing liquid to separate and drip through to the bottom of the trough 65. The finishing liquid may be recirculated, if desired, or simply allowed to drain into a collecting vessel or sewer. In the meantime, the workpieces and finishing media are urged toward the far end of the screen 66 by gravity and/or forces imposed on them by subsequently discharging tub contents.

At the remote end of the trough, the screen 66 is equipped with a wide-mesh insert 67 that allows the media, but not the workpieces, to drop through the insert 67 and into the lower end of conveyor 27. The conveyor 27 carries the finishing media toward its upper end for return to tub 20 through hopper 26. The workpieces are precluded by the wide-mesh insert 67 from dropping through this portion of the screen, and move onto an inclined run-off tray 68. The workpieces then fall by gravity into a waiting tote box or other receptacle.

In normal operation, the workpieces, together with the desired type or types of media, are vibrated in the tub 20, with the closure 40 in a discharge restricting position, for a selected retention period. The closure 40 is then moved to an open position which permits the tub contents, consisting of the workpieces media and fluid, etc., to spill out through the opening 39 into trough 65 and onto screen 66. After a suitable discharge interval, the closure 40 is moved toward a discharge restricting position.

Figure 5:
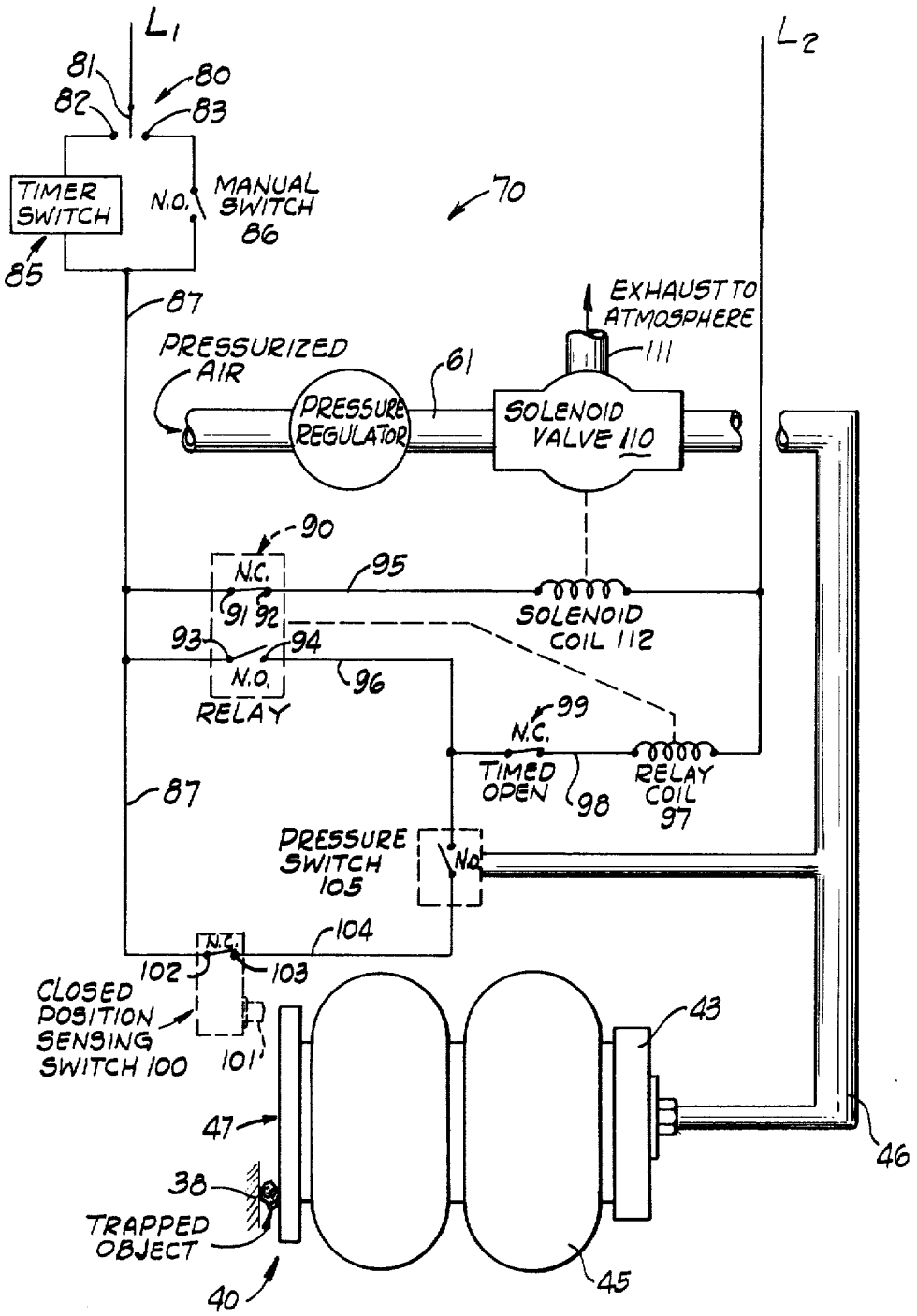
FIG. 5 is a schematic diagram of a control system for operating the closure assembly; and, FIG. 6 is a schematic diagram of portions of the closure control system of FIG. 5 as modified to stop closure movement with the closure in a discharge restricting position spaced from the discharge structure.

In accordance with the present invention, a control system 70 shown in FIG. 5 is provided for stopping, reversing, and reinitiating the closing movement of the closure 40 if an object is trapped between the closure 40 and the discharge structure 38. As will be explained, a pressure-operated switch monitors the pressure of the air supplied to the bellows 45. If this pressure rises above a predetermined level before the closure 40 has reached a predetermined discharge restricting position, indicating that an object has been trapped by the closure, the closure is reopened to release the object and is then automatically moved once again toward the predetermined discharge restricting position.

Referring to FIG. 5, the control system 70 is connected between two electrical conductors $L_1$, $L_2$ which represents a source of electricity. A selector switch 80 connects with the conductor $L_1$ and has a movable contact 81 for selectively engaaging a pair of contacts, 82, 83.

A pair of switches 85, 86 selectively establish electrical connection between the contacts 82, 83 and a conductor 87. The switch 85 is a programmable cycle timer capable of cyclically making and braking electrical connection between the contact 82 and the conductor 87. The switch 86 is a normally open manually operated switch for selectively establishing electrical connection between the contact 83 and the conductor 87.

As will be explained, when either of the switches 85, 86 together with the selector switch 80 are operable to establish electrical connection between the line conductor $L_1$ and the conductor 87, the bellows operated closure 47 will begin moving toward a discharge restricting position. When no electrical connection is made between the tire conductor $L_1$ and the conductor 87, the bellows operated closure 47 will open.

A double pole solenoid operated relay 90 is provided to effect the opening and closing movements of the closure 47. The relay 90 has a pair of normally closed contacts 91, 92, and a pair of normally open contacts 93, 94. The contacts 91, 93 are connected to the conductor 87. The contacts 92, 94 are connected respectively to conductors 95, 96.

The relay 90 has a solenoid coil 97 which, when energized, will open the contacts 91, 92 and will close the contacts 93, 94. One side of the coil 97 is connected to a conductor 98. The other side is connected to the line conductor $L_2$.

A time delay switch 99 of conventional construction is connected between the conductors 96, 98. The switch 99 is normally closed. When electrical current flows through the switch 99, a bimetallic element (not shown) is heated and eventually opens the switch 99 to break the connection between the conductors 96, 98. The time required for the switch 99 to open once currents begins flowing through it typically about 2 seconds.

A limit switch 100 is provided to sense when the bellows operated closure 47 is in a predetermined discharge restricting position. As is best seen in FIG. 3, the switch 100 is mounted on the discharge structure 38 and has an actuator button 101 positioned to be engaged and depressed by the closure 47. A pair of normally closed contacts 102, 103 are carried in the switch 101. When the actuator button 101 is depressed by the closure 47, the contacts 102, 103 open. The contact 102 is connected to the conductor 87. The contact 103 is connected to a conductor 104.

A pressure responsive switch 105 is connected between the conductors 96, 104. The switch 105 communicates with the pneumatic conduit 46 to sense the pressure of air supplied to the bellows 45. When the air pressure in the conduit 46 rises above a predetermined level, the switch 105 closes to electrically connect the conductors 96, 104.

A solenoid operated valve 110 is provided to selectively communicate the conduit 46 with an exhaust conduit 111 and with the pressurized air conduit 61. The valve 110 has a solenoid coil 112 which, when energized, will communicate the conduits 61, 46, and when de-energized, will communicate the conduits 111, 46. One side of the coil 112 is connected to the conductor 95. The other side of the coil is connected to the line conductor $L_2$.

In operation, when either of the switches 85, 86 connect the conductor 87 to the line conductor $L_1$, the normally closed contacts 91, 92 of the relay 90 will energize the solenoid coil 112, causing the valve 110 to communicate the conduits 61, 46. This supplies pressurized air to the bellows 45 causing the closure 47 to move toward a discharge restricting position. If an object should be trapped between the closure 47 and the discharge structure 38, as shown in FIG. 5, the bellows 45 will not be able to complete the movement of the closure 47 and the pressure in the conduit 46 will rise.

When the pressure in the conduit 46 reaches a predetermined level, the pressure switch 105 closes, energizing the relay coil 97. The relay 90 then opens the contacts 91, 92 and closes the contacts 93, 94. The opening of the contacts 91, 92 deenergizes the solenoid valve 110, exhausting the conduit 46 to atmosphere and permitting the closure 47 to open under the influence of the springs 57. The closing of the contacts 93, 94 keeps the relay coil 97 energized until the timed switch 99 breaks the connection between the conductors 96, 98. By the time the switch 99 opens, the closure 47 has returned to its open position and is ready to be recycled. The pressure switch 105 reopens as soon as the conduit 46 is exhausted to atmosphere by the solenoid valve 110.

When the relay coil 97 is de-energized by the timed switch 99, the contacts 91, 92 reclose to initiate closure movement of the closure 47, and the contacts 93, 94 reopen. If the previously trapped object has dropped from between the closure 47 and the discharge structure 38, and if no other objects become trapped as the closure 47 moves to a discharge restricting position, the closure 47 will engage the actuator button 101 of the switch 100, opening the contacts 102, 103. When the contacts 102, 103 are open, the pressure switch 105 is unable to energize the relay coil 97. This enables the air pressure supplied to the bellows 45 to increase above the predetermined level which closes the switch 105, to effect a secure seating of the closure at a predetermined discharge restricting position.

In the apparatus embodiment illustrated in FIGS. 3–5, the discharge restricting position which is eventually reached by the closure 47 is one where the closure 47 engages the discharge structure 38 and fully closes the discharge opening 39. While in some finishing operations it may be desiriable to fully close the discharge opening 39, it has been found that in many finishing operations, an incomplete closure of the opening 39 is desirable.

In the preferred practice of the present invention, the closure 47 is moved between an open position as described above and a discharge restricting position where the closure 47 is spaced a predetermined distance from the discharge structure 38. The spacing distance is selected such that it is large enough permit passage of finishing media between the discharge structure 38 and the closure 47, but is small enough to prevent the discharge of workpieces. This arrangement has a number of advantages, principal among which is that finishing media does not become trapped between the closure 47 and the discharge structure when the closure 47 is moved to its discharge restricting position. The closure control 70 accordingly need only effect reversal of the closure 47 if a workpiece becomes trapped between the closure 47 and the discharge structure 38.

Only two modifications need be made to the described finishing machine 10 to provide the machine with a capability for stopping closure movement at a position spaced from the discharge structure 38. One of the modifications involves the provision of stops to define the desired closure restricting position. The other modification involves moving the switch 100 so that its actuator button 101 will be engaged by the closure 47 as the closure 47 reaches the desired closure restricting position.

Figure 6:
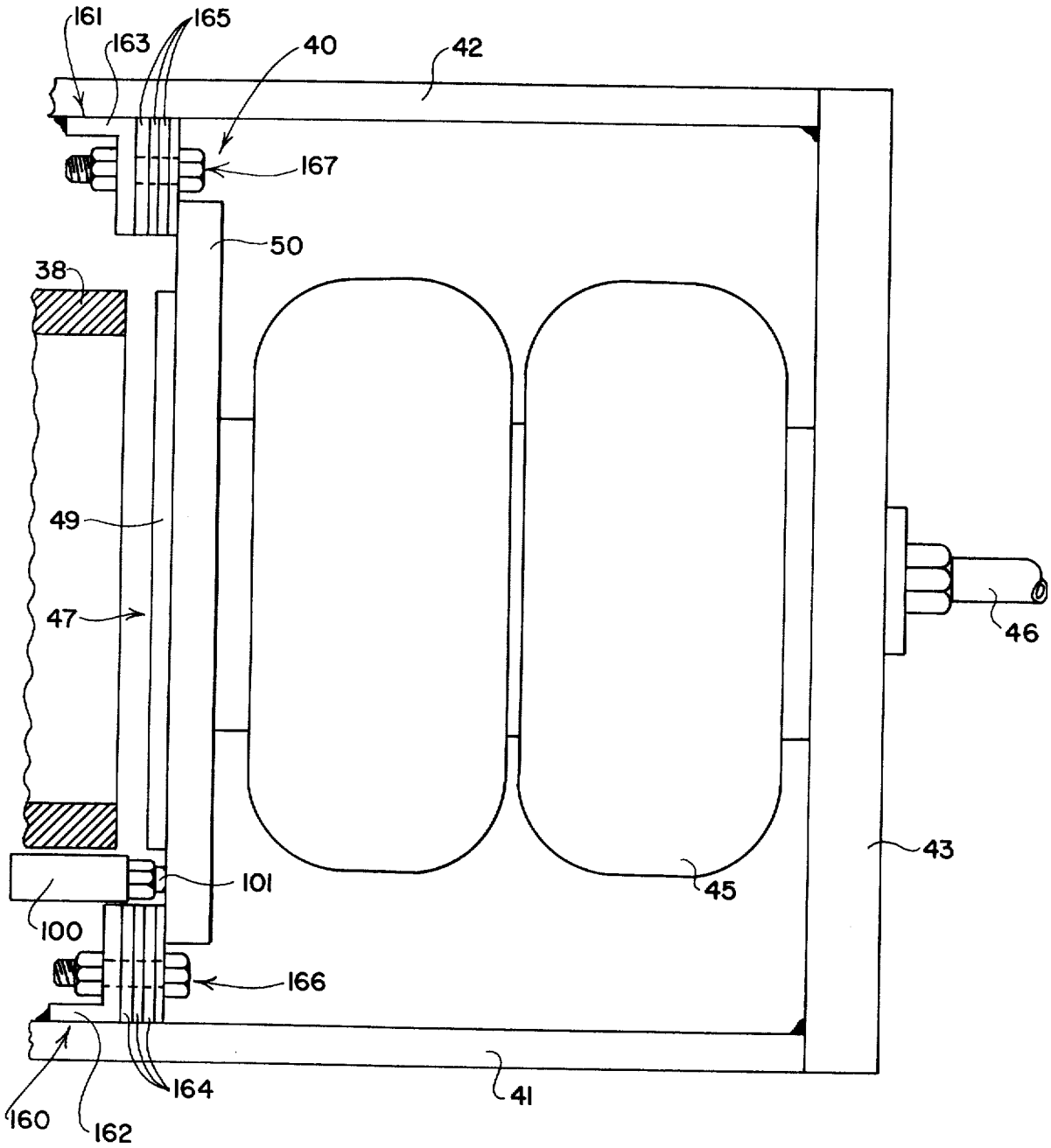

Referring to FIG. 6, adjustable stop assemblies 160, 161 are provided on the side plates 41, 42 to engage the closure mounting plate 50 when the closure 47 reaches a predetermined discharge restricting position spaced from the discharge structure 38. The switch 100 is shown in a position where its actuating button 101 is engaged by the mounting plate 50 as the closure 47 arrives in the discharge restricting position.

The stop assmblies 160, 161 include a pair of angle iron brackets 162, 163 which are welded to the side plates 41, 42. A plurality of spacer plates 164, 165 are interposed between the angle iron brackets 162, 163 and the closure mounting plate 50. Threaded fasteners, indicated generally by the numerals 166, 167 extend through aligned holes formed in the brackets 162, 163 and in the spacer plates 164, 165 to hold the plates 164, 165 in position on the brackets 162, 163.

The stop assemblies 160, 161 can readily be adjusted to change the spacing which is achieved between the closure 47 and the discharge structure 38 by increasing or decreasing the number of spacer plates 164, 165 carried on the bracket 162, 163. The stop assemblies 160, 161 accordingly provide a simple adjustable means for defining the discharge restricting position to which the closure 47 is moved by the closure control system 70.

Although the invention has been described in its preferred form with a certain degree of particularlity, it is understood that the present disclosure of the preferred from has been made only by way of example and that numerous changes in the details of construction and the combination and arrangement of parts may be resorted to without departing from the spirit and the scope of the invention as hereinafter claimed.

What is claimed is:

1. A vibratory finishing machine comprising:

a. a supporting frame structure;

b. a tub structure carried on said frame structure but free to vibrate relative to said frame structure;

c. a vibration producing mechanism operably connected to said tub structure to vibrate said tub structure;

d. discharging means for controllably discharging materials from said tub structure, including:

i. opening means defining a discharge opening in communication with said tub structure;

ii. closure means movable toward and away from said opening means for selectively restricting the discharge of materials from said tub structure through said discharge opening to selectively retain and discharge materials in and from said tub structure;

iii. closure operator means connected to said closure means for moving said closure means toward and away from said opening means to selectively restrict the discharge of materials from said tub structure through said discharge opening during the operation of said machine;

iv. sensor means for sensing an object trapped between said closure means and said opening means; and, v. control means responsive to said sensing means and being connected to said closure operator means for reversing the movement of said closure means toward said opening means when an object is trapped between said closure means and said opening means to release such object.

2. The vibratory finishing machine of claim 1 additionally including stop means for stopping the movement of said closure means toward said opening means when said closure means has reached a discharge restricting position spaced from said opening means.

3. The vibratory finishing machine of claim 2 wherein said stop means is adjustable to stop the movement of said closure means at a selected distance from said opening means.

4. The vibratory finishing machine of claim 1 wherein said control means includes a timing control to move said closure means toward and away from said opening means at predetermined intervals of time during the operation of the machine, whereby the retention time of workpieces within the tub is controlled by the timing control.

5. The vibratory finishing machine of claim 1 wherein said control means is additionally operable to initiate movement of said closure means toward said opening after said closure means has reversed direction to release such object.

6. The vibratory finishing machine of claim 5 wherein said control means includes time delay means for delaying by a predetermined interval of time the initiation of movement of said closure means toward said opening after said closure means has reversed direction to release such object.

7. The vibratory finishing machine of claim 1 wherein:

a. said closure operator means includes a pneumatic structure operable when supplied with pressurized air to move said closure means toward said opening means; and b. said control means includes pressure responsive means for sensing the pressure of pressurized air supplied to said pneumatic structure during the movement of said closure means toward said opening means, and for initiating the reversal of movement of said closure means when said pressure exceeds a predetermined value.

8. The vibratory finishing machine of claim 7 wherein said control means additionally includes second sensor means for sensing when said closure means has reached a position near said opening means and for disabling the operation of said pressure responsive means to permit said pressure to rise above said predetermined magnitude.

9. A continuous feed vibratory finishing machine comprising:

a. a supporting structure resiliently supporting a tub together with means for vibrating said tub relative to the supporting structure;

b. charging means and discharging means arranged to introduce into and discharge from said tub at spaced regions of the tub such materials as workpieces and finishing media, whereby said machine is operable in a continuous feed mode;

c. said discharge means having wall portions defining a discharge opening in communication with said tub;

d. discharge rate control means including:

i. means movable selectively toward and away from said discharge opening to selectively restrict the passage through said opening of workpieces from said tub;

ii. operator means connected to said movable means for effecting movement of said movable means;

iii. sensor means for sensing when an object has become trapped between said movable means and said discharge means;

iv. control means connected to said operator means for controlling the movement of said movable means toward and away from said discharge means to control the retention time of workpieces within the tub; and v. said control means being operable to reverse and subsequently reinitiate the movement of said movable means toward said discharge means when an object is trapped between said movable means and said discharge means, whereby such object is free to move from between said movable means and said discharge means before said movable means is again moved toward said discharge means.

10. The vibratory finishing machine of claim 9 additionally including stop means for stopping the movement of said movable means toward said discharge opening when said movable means has reached a discharge restricting position spaced from such portions of said discharge means as define said discharge opening.

11. The vibratory finishing machine of claim 10 wherein said stop means is adjustable to stop the movement of said movable means at a selected distance from such portions of said discharge means as define said discharge opening.

12. The vibratory finishing machine of claim 9 wherein said control means includes programmable means operable to effect movement of said movable means in accordance with a preselected cycle of operation.

13. The vibratory finishing machine of claim 9 wherein said control means includes time delay means for delaying by a predetermined interval of time the initiation of movement of said movable means toward said discharge means after said movable means has reversed direction to release such object.

14. The vibratory finishing machine of claim 9 wherein:

a. said operator means includes a pneumatic structure operable when supplied with pressurized air to move said movable means toward said discharge means; and b. said control means includes pressure responsive means for sensing the pressure of pressurized air supplied to said pneumatic structure during the movement of said movable means toward said discharge means, and for initiating the reversal of movement of said movable means when said pressure exceeds a predetermined value before said movable means reaches a position near said discharge means.

15. The vibratory finishing machine of claim 14 wherein said control means additionally includes second sensor means for sensing when said movable means has reached a position near said discharge means and for disabling the operation of said pressure responsive means to permit said pressure to rise above said predetermined magnitude.

16. A process of finishing workpieces in the tub of a vibratory finishing machine having movable structure for selectively moving toward and away from a tub discharge opening to restrict and permit the discharge of materials from a finishing machine tub through the tub discharge opening, comprising the steps of:

a. feeding workpieces and media into the tub at a location spaced from said discharge opening;

b. vibrating the tub to impart a motion to the workpieces and media to perform a finishing operation on the workpieces and to move the workpieces and media from said location toward the discharge opening;

c. moving said movable structure toward and away from said discharge opening in accordance with a predetermined cycle of operation to control the retention time of workpieces with the tub;

d. sensing when an object trapped has become trapped between said movable structure and the tub; and, e. reversing and reinitiating the movement of said movable structure toward said discharge opening when an object has become trapped between said movable structure and the tub to release such object so movement of said movable structure to a position near said discharge opening can be effected.

17. The process of claim 16 additionally including the steps of subsequently moving said movable structure toward said discharge opening and stopping the movement of said movable structure at a position spaced from such portions of the tub as define said discharge opening.

18. The process of claim 17 wherein said step of stopping the movement of said movable movable structure is effected by bringing portions of said movable structure into engagement with a stop structure.

19. The process of claim 16 where the movement of said movable structure is effected in accordance with a preselected cycle of operation whereby the movement of said movable structure establishes an effectively uniform rate of discharge of materials from the tub.

20. In a vibratory finishing machine of the type including a tub for receiving workpieces and finishing media for vibration to effect a finishing action on the workpieces, the combination comprising:

a. feeding means for feeding workpieces and media into the tub at a first location;

b. drive means for vibrating the tub to impart a motion to workpieces and media in the tub to perform a finishing operation on the workpieces and to move the workpieces and media from said first location toward a discharge location;

c. movable means for selectively restricting the passage of materials from said tub through a discharge opening formed in the tub at said discharge location in accordance with a predetermined cycle of operation to control the retention time of workpieces within the tub;

d. sensing means for sensing when an object has become trapped between said movable means and said tub; and e. control means for reversing and re-initiating the movement of said movable means toward said opening when an object has become trapped between said movable means and the tub to release the trapped object so movement of said movable means to a position near said discharge opening can be effected.

21. The vibratory finishing machine of claim 20 additionally including stop structure positioned to engage and stop the movement of said movable means toward said discharge opening when said movable means has reached a predetermined position near said discharge opening.

22. The vibratory finishing machine of claim 21 wherein said position near said discharge opening is defined by said stop structure such that a space remains between said movable means and such portions of the tub as define said discharge opening, said space having a width sufficient to permit the passage therethrough of finishing media but being of insufficient width to permit the passage therethrough of workpieces.

23. The vibratory finishing machine of claim 22 wherein said stop structure is adjustable to stop the movement of said movable means at any one of a selected number of such space widths.

24. In a vibratory finishing machine of the type including a tub for receiving workpieces and finishing media for vibration to effect a finishing action on the workpieces, the combination comprising:

a. feeding means for feeding such materials into the tub at a first location;

b. drive means for vibrating the tub to impart a finishing action to materials within the tub and to move such materials from said first location to a discharge location;

c. movable means for selectively restricting the passage of materials from said tub through a discharge opening formed in the tub at said discharge location in accordance with a predetermined cycle of operation to control the retention time of workpieces within the tub;

d. said movable means being movable from a position where the passage of materials through said opening is not substantially restricted to a position near to but spaced a predetermined distance from such portions of the tub as define said opening to restrict the flow of materials through said opening; and e. adjustable stop means for adjusting said predetermined distance.

25. The apparatus of claim 24 wherein said adjustable stop means engages said movable means when said movable means reaches said position near said portions.

* * * * *